US006450070B1

(12) United States Patent
Winkler et al.

(10) Patent No.: US 6,450,070 B1
(45) Date of Patent: Sep. 17, 2002

(54) LOCKING PLIER TOOL

(76) Inventors: John Andrew Winkler, 600 N. Pantano Rd. #121, Tucson, AZ (US) 85710; William Edward Ringer, 1598 N. Fremont St., Tucson, AZ (US) 85719

( * ) Notice: Subject to any disclaimer, the term of this patent is extended or adjusted under 35 U.S.C. 154(b) by 0 days.

(21) Appl. No.: 09/971,431

(22) Filed: Oct. 5, 2001

(51) Int. Cl.[7] ..... B25B 7/12

(52) U.S. Cl. ..... 81/367; 81/384

(58) Field of Search ..... 81/367–384, 316, 81/334, 341, 362–363, 388–389, 395, 398–399

(56) References Cited

U.S. PATENT DOCUMENTS

| | | | | |
|---|---|---|---|---|
| 2,628,521 A | * | 2/1953 | Berglund et al. | 81/377 |
| 2,800,823 A | * | 7/1957 | Tugend | 81/370 |
| 4,274,352 A | | 6/1981 | Hamel | |
| 4,725,049 A | | 2/1988 | Cantarinhas | |
| 6,041,680 A | | 3/2000 | Wang | |

* cited by examiner

*Primary Examiner*—D. S. Meislin

(57) ABSTRACT

A locking plier tool of the threaded shaft design which has an adjustment dial located in the midbody of the fixed handle. This dial location affords the operator the ability to adjust the jaw gap of the tool with the thumb digit while simultaneously handling the plier body with the finger digits of the same hand, making the jaw gap adjustment a one hand operation.

18 Claims, 5 Drawing Sheets

LOCKING PLIER TOOL

FIELD OF THE INVENTION

This invention relates to the field of portable hand tools known as "locking pliers", which allow adjustment of a set of opposable plier jaws which are pivotally fastened to one another, and are able to clamp and restrain a workpiece of variable size and geometry without continuous gripping effort from the operator.

PRIOR ART

A study of the prior art, such as U.S. Pat. Nos. 5,992,273 and 6,012,361, shows that those locking plier designs which have a thumbscrew means of adjustment require the use of two hands to achieve the adjustment. The operator uses one hand to hold the body of the pliers and uses a second hand to spin the thumbscrew to achieve the proper gap distance between jaws for clamping the workpiece. The solo operator has no hands available to hang on to the workpiece while the plier is adjusted to the proper jaw gap setting.

The significant advantage of the thumbscrew variation of a locking plier tool is the ability to continuously adjust the gap distance between the jaws of the tool. Properly adjusted, the linkage mechanism is able to exert very large clamping forces on the workpiece and lock the jaws in place to maintain a continuous clamping force on the workpiece without a constant grip force from the operator.

The rotational advance or retreat of the adjustment link coupled to the screw permits analog adjustment to be achieved over the entire range of workpiece sizes able to be clamped by the plier. A ball detent or pinion gear tooth adjustment is not truly practical for jaw adjustment of the tool as such methods limit adjustment to the discrete step size allowed by the resolution of the ball detents or the gear tool spacing. The rotary adjustment of a screw thread is preferred to achieve the correct jaw gap setting to clamp the workpiece. Many different locking plier designs recognize this important feature as is demonstrated not only by commercially available pliers such as the trade name VISE GRIP (R) locking plier, but also those of U.S. Pat. Nos. 6,199,458 B1 and 6,012,361. The only advantage in U.S. Pat. No. 6,012,361 is that the plier body length remains constant. The user must still perform the thumbscrew adjustment using two hands. U.S. Pat. No. 6,199,458 B1 also has this problem of two handed coarse adjustment. While U.S. Pat. No. 6,199,458 B1 has a thumb-accessible slide on one of the handles of the tool, this release slide actuator is not used for jaw gap adjustment before clamping but instead is used for releasing the grip of the tool on the workpiece when finished.

Warheit touches on the notion of a thumb digit means of adjustment in U.S. Pat. No. 6,095,019, but has no screw adjustment in his invention to effect the movement of the pivotable jaw. The coarse adjustment is effected by a guide plate and sliding wedge first slipping past each other for gap setting and then frictionally engaging once the gap size is set by the user via a control member. The assembly is not only costly and cumbersome to manufacture, but also allows the opportunity to jam and incapacitate the guide plate and sliding wedge piece parts of the tool with the introduction of grime in the slot channels of the control member.

BRIEF SUMMARY OF THE INVENTION

The disclosed invention is a locking plier hand tool with an adjustment link for varying the opening between a fixed and a movable jaw of the tool, and includes a threaded shaft journaled between proximal and distal bearings, preferrably designed as bearing surfaces, and also includes a thumb dial, or adjustment dial, positioned distally to the adjustment link. Unlike the prior art, the screw adjustment means of the invention is found in the midbody of the tool, near the average user's thumb location, instead of at the proximal end of the fixed handle. The threaded shaft is journaled on two bearing surfaces which gives more stability for smoother operation, and prevents misalignment between the shaft and the bearing surfaces within which it is held, which could cause jamming or difficulty rotating the thumb dial.

The advantage of the tool design is that it places a thumb dial in a distal position with respect to the adjustment link and also in a position that nearly approximates the location of an average user's thumb when holding the tool, permitting single handed jaw opening adjustment through the use of the thumb digit. The single handed adjustment capability of the disclosed invention frees the other hand of the operator for workpiece manipulation during the gap adjustment or workpiece clamping operation.

DETAILED DESCRIPTION OF THE INVENTION

Figure 1:
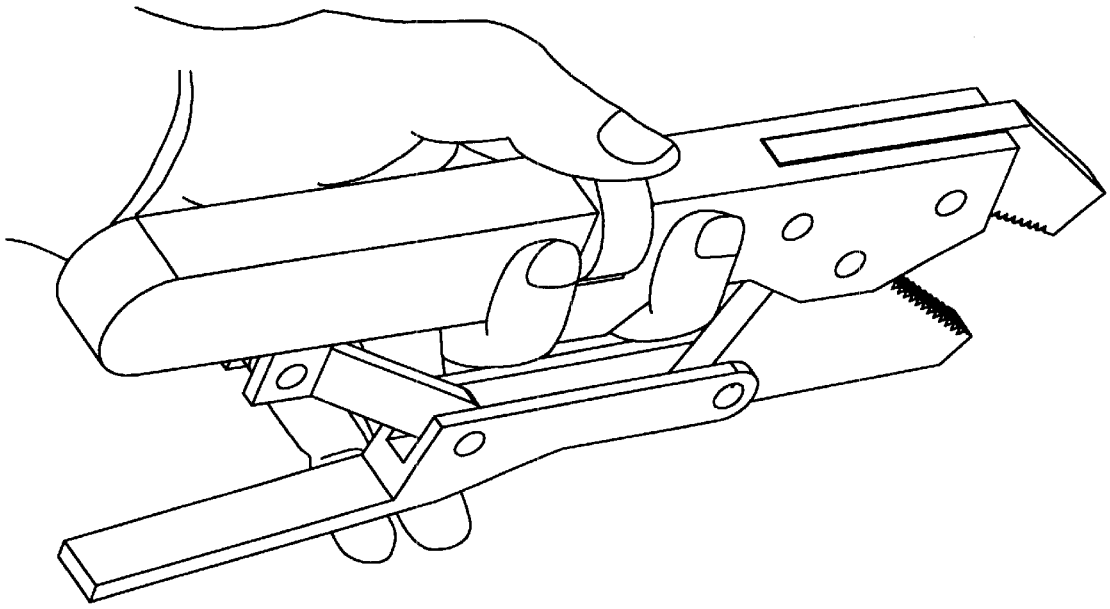
FIG. 1 shows an isometric view of the locking plier tool as assembled.

In the figures, similar reference numbers denote similar elements throughout the several views. Shown in FIG. 1 is the disclosed invention held in the hand of an operator. Jaw gap adjustment of the tool is performed by the operator using the thumb digit to roll the adjustment dial clockwise or counterclockwise while holding on to the locking plier with the same hand. The dial is highlighted in FIG. 2.

Figure 2:
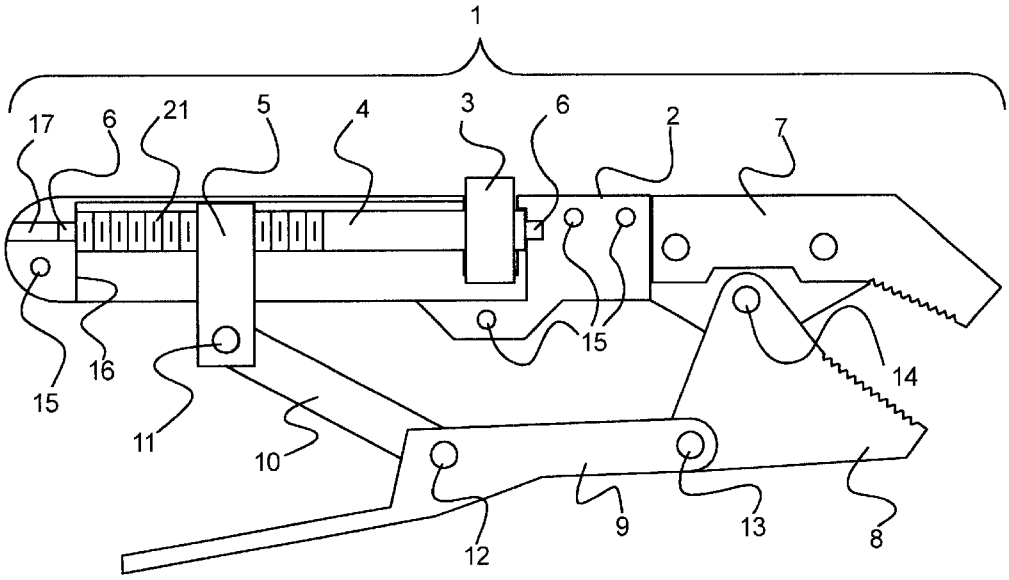
FIG. 2 shows a cutaway view of the assembled locking plier in an unclamped setting.

As shown in FIG. 2, the locking plier tool 1 of the invention has very few parts and is simplistic in design. In FIG. 2, the fixed handle 2 of the tool has been cut away to show the moving components of the invention. The overall function of the tool is to clamp and controllably secure a workpiece in the gap between the fixed jaw 7 and the opposable, movable jaw 8. Proper gap setting is achieved by turning the threaded shaft 4 via the adjustment dial, or thumb dial, 3. As the threaded shaft rotates, the external threads 21 of the shaft engage internal threads of the adjustment link 5. Through this thread engagement the adjustment link 5 is coupled to the shaft 4 for longitudinal motion of the link as the thumb dial 3 is rotated. The longitudinal motion of the adjustment link increases or decreases the distance of the adjustment link from the resting face 16. The turning of the thumb dial 3 is achieved by the operator gripping the fixed handle 2 lightly with the finger digits and rolling the thumb digit across the surface of the adjustment dial to turn the dial and shaft clockwise or counterclockwise. The chain of components comprising the threaded shaft 4, the adjustment link 5, and the adjustment dial 3, creates a jaw-tightening mechanism for proper jaw gap setting. Positioning the adjustment link further away from the resting face decreases the gap distance between the fixed and movable jaws. Decreasing the adjustment-link-to-resting-face distance increases the jaw gap. Through this adjustment capability, workpieces of any size able to fit between the jaws can be clamped and held by the tool.

Figure 5:
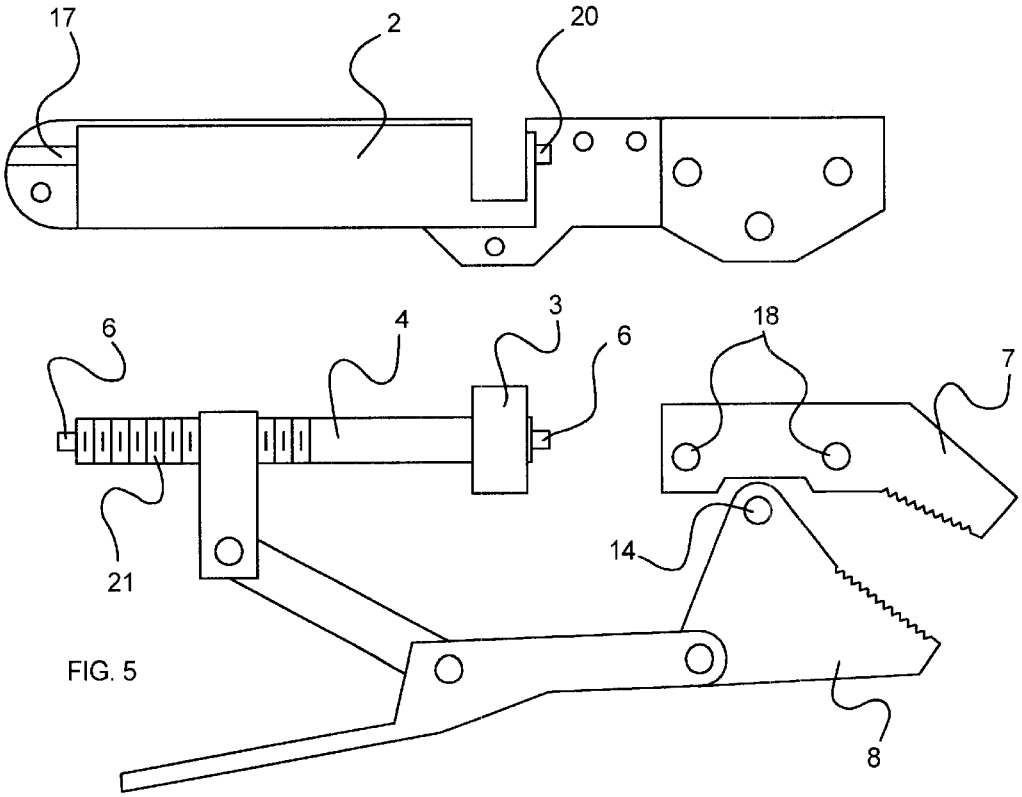
FIG. 5 shows an exploded view of the key components of the locking plier invention.

It is shown in FIG. 5 that at the ends of the threaded shaft are shaft journals 6 that are rotatably mounted between two bearings. The first bearing is preferrably a proximal bearing surface 17, and the second bearing is preferrably a distal bearing surface 20, so that the threaded shaft always maintains the same axis of rotation relative to the fixed handle 2 as constrained by the bearings.

The thumb dial 3 consists of a structure fixed with respect to the shaft 4, so that the rotation of the shaft may be directly effected by action of the dial. Preferrably the dial 3 and shaft 4 are of unitary construction but can also be separate components whose relation is fixed during the assembly process. The threaded shaft 4 can be either left or right hand threaded and can be either coarse or fine threaded for increased load bearing capacity of the threaded shaft. Too coarse of a thread will allow undesirable backdriving of the threaded shaft by the adjustment linkage attempting to retreat during clamping. In an alternative embodiment of the invention, a gear reduction mechanism could be introduced in order to facilitate the rotation of the shaft. In any event, the thumb dial 3 is positioned in front of the adjustment link 5, so as to roughly match the position of the thumb of a user's hand gripping the tool.

In FIG. 2, the vector passing through the first pin 11 and the second pin 12 is shown to be non-colinear with the vector passing through the second pin 12 and the third pin 13. This is obvious by the orientation of the joining link 10 relative to the handle 9 and a slight angle between the two components. This is the unclamped position of the tool.

To clamp the tool jaws onto a workpiece, the dial 3 is rotated in the proper direction to create a jaw gap opening just slightly wider than the workpiece to be clamped. The clamping handle 9 and fixed handle 2 are squeezed together by the grip of the operator. Since the adjustment link 5 is unable to slide down the threaded shaft, and the threaded shaft is pressed against the resting face 16, the adjustment link is unable to move relative to the fixed jaw 7. As the clamping handle 9 is continued to be gripped and coaligned to the joining link 10, the distance between the first pin 11 and the third pin 13 increases, which forces the movable jaw 8 to rotate about the fourth pin 14 towards the fixed jaw 7. This slight jaw rotation, if the gap has been properly set, contacts the fixed and movable jaws against the surfaces of the workpiece and begins to clamp the workpiece between the jaws.

Figure 3:
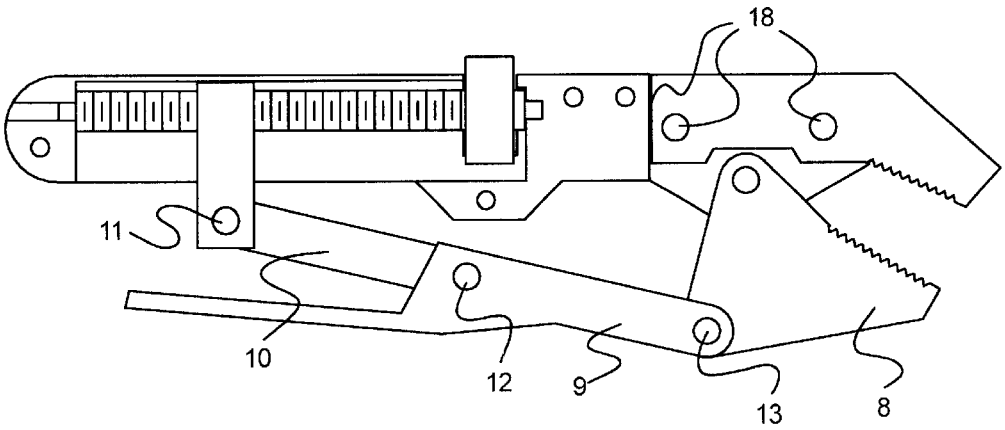
FIG. 3 shows a cutaway view of the locking plier in a clamped setting with a large gap between the opposable jaws.

Similar to most other locking plier tools, the invention is designed to create a self locking condition when the joining link 10 and clamping handle 9 are coaligned. A self locking condition immobilizes the movable jaw. FIG. 3 shows the coalignment of these two components of the tool when a complete clamping condition has been achieved. When the link and handle components are coaligned, forces exerted by the clamping of the movable jaw 8 can be transmitted in a straight line from the third pin 13, through the second pin 12, to the first pin 11. Forces from the jaw which have been transmitted to the first pin are reacted by the now unmoving adjustment link 5, threaded shaft 4, and resting face 16, all stationary to the fixed handle 2. Movement of the fixed jaw relative to the fixed handle is opposed at all times by the fixed jaw attachment means 18, such as rivets or weld means, fastening the fixed jaw to the fixed handle. In the coaligned position the jaws of the tool should be clamped about the workpiece in a manner to controllably constrain the workpiece.

Figure 4:
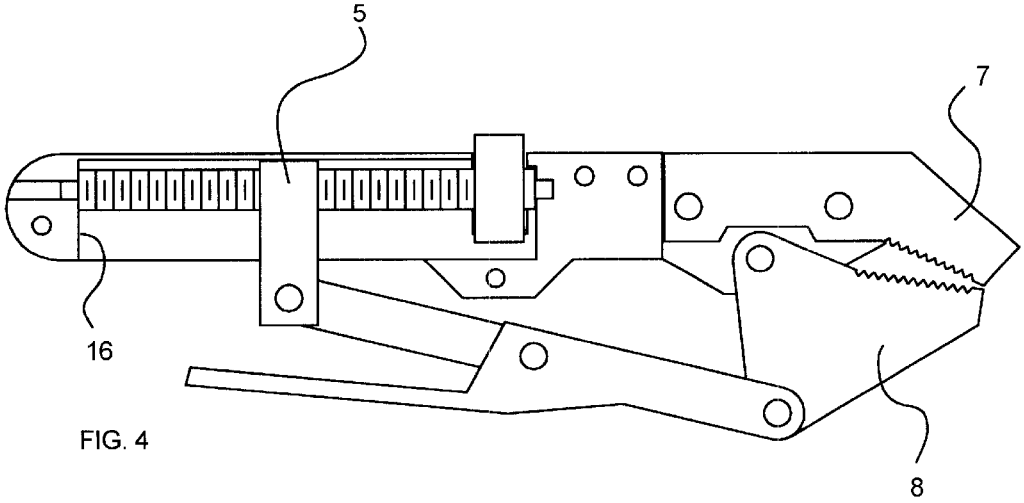
FIG. 4 shows a cutaway view of the locking plier in a clamped setting with a very small gap between the opposable jaws.

FIG. 4 is very similar to FIG. 3; however, close comparison of the figures reveals a repositioning of the adjustment linkage 5 in FIG. 4, which has affected the jaw gap distance in FIG. 4. FIG. 4 has been illustrated to show that repositioning the adjustment link member 5 farther away from the resting face 16 creates a smaller gap between the jaws of the tool in the clamping position.

FIG. 5 is used to more clearly separate the individual components comprising the functional tool. The proximal bearing surface 17, and distal bearing surface 20, which seat the shaft journals 6 are used to keep a constant axis of rotation relative to the fixed handle 2 for the threaded shaft 4. As a completed assembly, the fixed jaw 7 is immovably mounted to the fixed handle 2 and the movable jaw 8 is pivotally mounted to the fixed handle about the fourth pin location, shown as 14.

Figure 6:
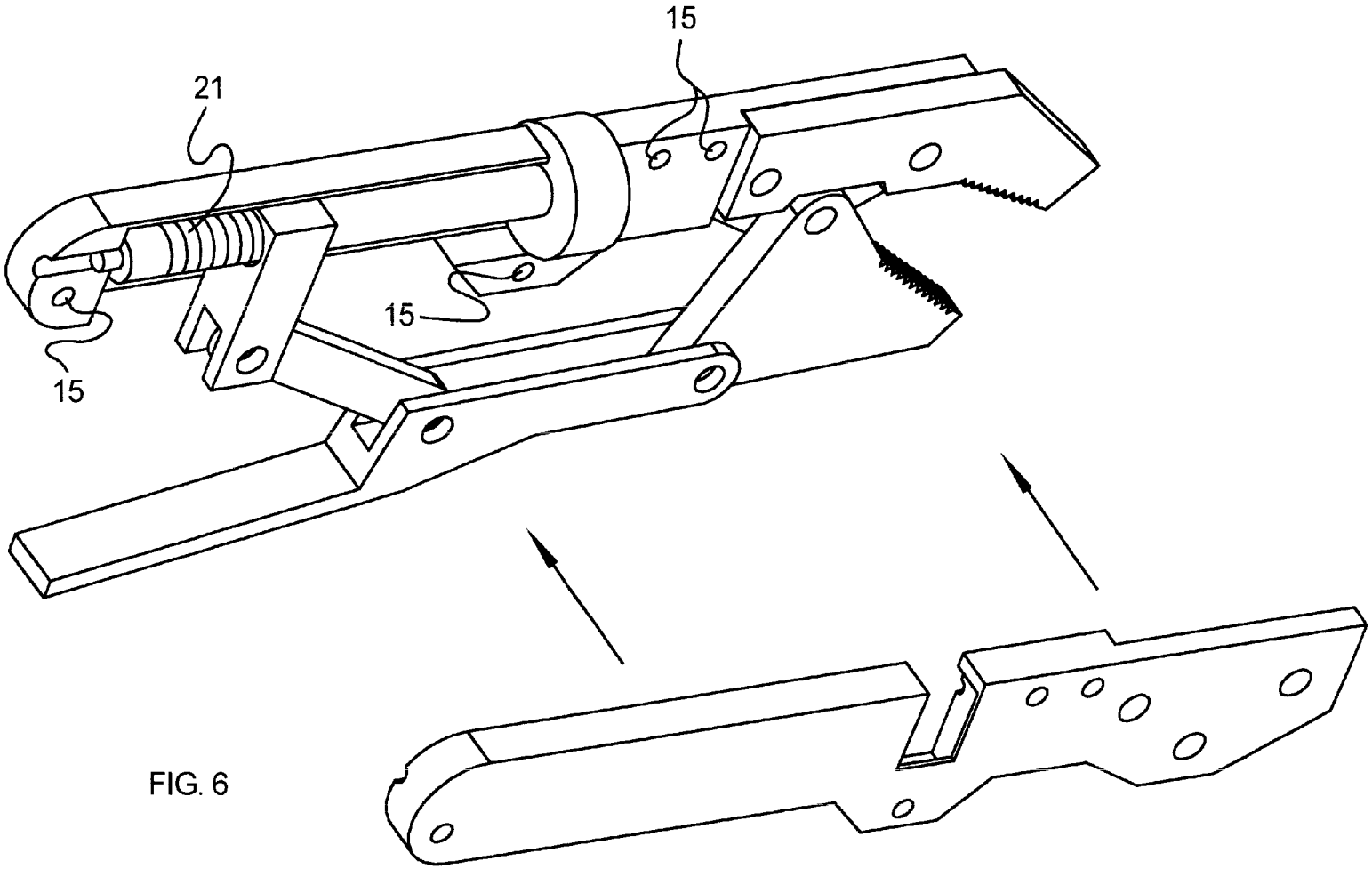
FIG. 6 shows an isometric view of the components of the locking plier invention.

The fixed handle itself can be constructed through several means known in the art. The preferred, cost effective technique would be to shape the handle as a single piece out of adequately thick sheet metal and install the threaded shaft and dial into their respective cavities of the formed sheet metal through an assembly technique known in the art. Alternatively, however, the fixed handle could be fashioned as two mating halves which rivet, weld or otherwise fasten together to capture the jaws and jaw-tightening mechanism. Casting or forging the handle are also viable techniques of the art as long as the threaded shaft and dial are able to be installed into the handle through a known technique of piecepart assembly. FIG. 6 shows the last step of an assembly technique wherein the mating half of a two piece fixed handle design is joined to the first half which already contains all of the assembled pieceparts forming the locking plier. The two halves are then fastened together through fastening means, such as screws or rivets, through fastening locations 15, or by welding.

Figure 7:
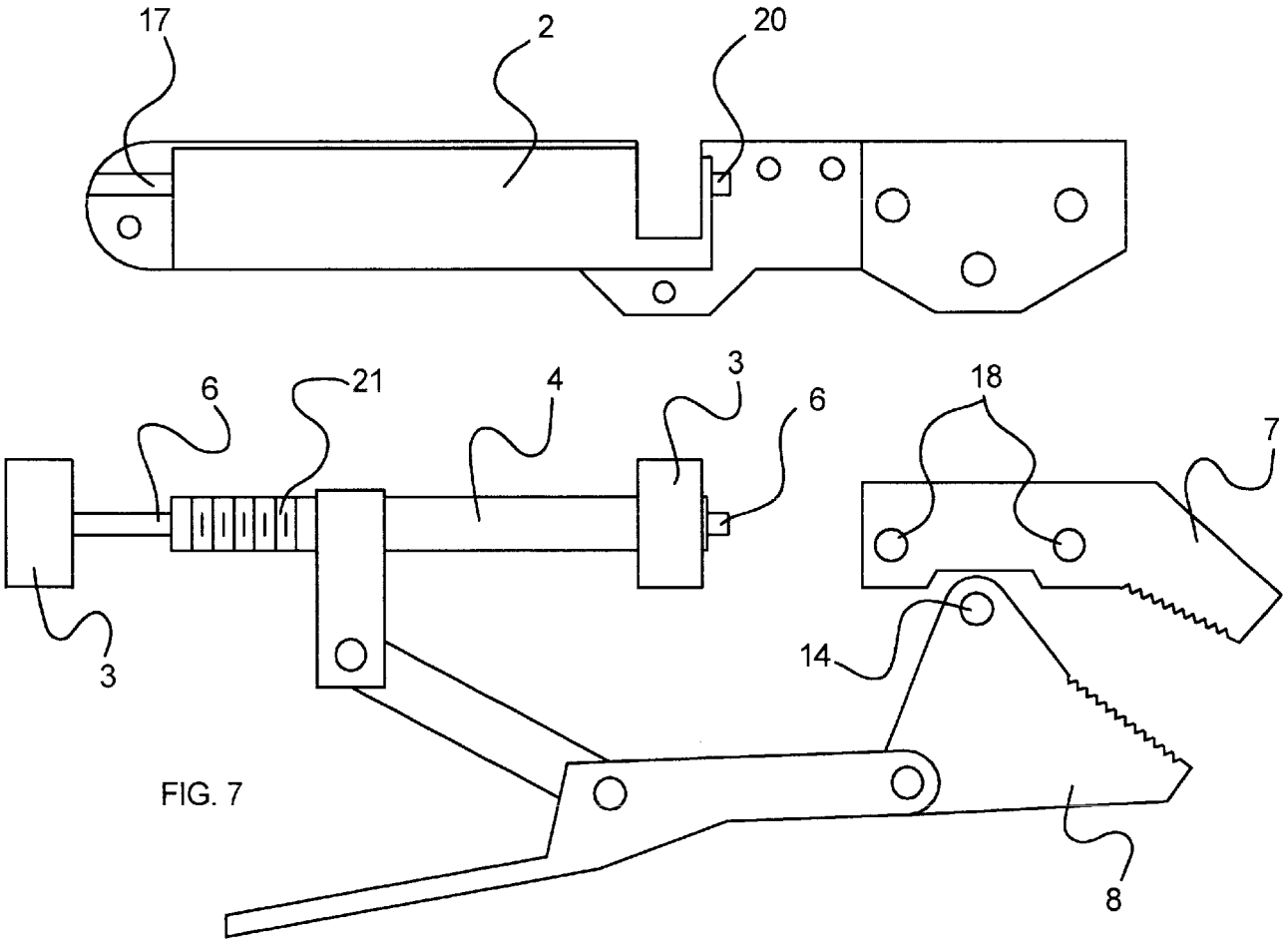
FIG. 7 shows a plan view of an alternative design of the invention.

An alternative design is shown in FIG. 7 wherein the threaded shaft carries two thumb dials 3, one at the shaft distal end, internal to the fixed handle, and another at the shaft proximal end, external to the fixed handle. The distal thumb dial, proximal thumb dial, and threaded shaft can all be of unitary construction provided that the adjustment link component offers a means of assembly such as being made of two mating halves joined around the threaded shaft. Similarly, one of the adjustment dials may be joined to the threaded shaft after assembly of the adjustment link onto the threaded shaft. Though rather unnecessary from a functional standpoint, the second dial can be used by the operator who is of the opinion that an external dial affords greater speed of coarse adjustment. The speed-conscious operator may make rapid gap adjustment with the proximal dial and then use the distal dial to make fine adjustment of the jaw gap setting. This variation is shown only for completeness and is not preferred.

While the embodiments described herein are at present considered to be preferred, it is understood that various modifications and improvements may be made therein without departing from the invention. The scope of the invention is indicated in the appended claims and all changes that come within the meaning and range of equivalency of the claims intended to be embraced therein.

We claim:

1. An improved locking pliers comprising a handle, opposing jaws connected to a distal end of the handle, a jaw-tightening mechanism that includes a threaded shaft mounted within the handle, an adjustment link threadedly coupled to the threaded shaft, and an adjustment dial adapted to effect rotation of the threaded shaft, wherein the improvement comprises: a proximal bearing supporting a first journal in a proximal end of said threaded shaft; and a distal bearing supporting a second journal in a distal end of the threaded shaft.

2. The pliers of claim 1, wherein said adjustment dial is located distally of the adjustment link within the handle of the pliers.

3. The pliers of claim 1, wherein said adjustment dial is integral with the threaded shaft.

4. The pliers of claim 2, wherein said adjustment dial is integral with the threaded shaft.

5. The pliers of claim 2, further comprising a second adjustment dial coupled to the threaded shaft and located proximally of the adjustment link.

6. The pliers of claim 5, wherein a portion of said second journal extends proximally out of the handle, and the second adjustment dial is coupled to said portion of the second journal.

7. The pliers of claim 6, wherein said second adjustment dial is integral with said portion of the second journal.

8. The pliers of claim 7, wherein said adjustment dial is integral with the threaded shaft.

9. The pliers of claim 1, wherein at least one of said proximal and distal bearings includes a cylindrical bearing surface.

10. The pliers of claim 8, wherein at least one of said proximal and distal bearings includes a cylindrical bearing surface.

11. Locking pliers comprising:

a handle;

opposing jaws connected to a distal end of the handle;

a jaw-tightening mechanism that includes a threaded shaft mounted within the handle;

a bearing supporting the threaded shaft in journaled arrangement;

an adjustment link threadedly coupled to the threaded shaft; and an adjustment dial adapted to effect rotation of the threaded shaft;

wherein the adjustment dial is located distally of the adjustment link within the handle of the pliers.

12. The pliers of claim 11, wherein said adjustment dial is integral with the threaded shaft.

13. The pliers of claim 11, further comprising a second adjustment dial coupled to the threaded shaft and located proximally of the adjustment link.

14. The pliers of claim 13, wherein a portion of said threaded shaft extends proximally out of the handle, and the second adjustment dial is coupled to said portion of the threaded shaft.

15. The pliers of claim 14, wherein said second adjustment dial is integral with said portion of the threaded shaft.

16. The pliers of claim 15, wherein said adjustment dial is integral with the threaded shaft.

17. The pliers of claim 11, wherein said bearing includes a cylindrical bearing surface.

18. The pliers of claim 16, wherein said bearing includes a cylindrical bearing surface.

* * * * *